US007219390B2

(12) United States Patent
Johnson et al.

(10) Patent No.: US 7,219,390 B2
(45) Date of Patent: May 22, 2007

(54) SURFACE CLEANER WITH FOLDING UPRIGHT HANDLE AND METHOD OF PACKAGING SAME

(75) Inventors: Michael A. Johnson, West Olive, MI (US); Kevin S. Breuker, Hudsonville, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 536 days.

(21) Appl. No.: 10/707,392

(22) Filed: Dec. 10, 2003

(65) Prior Publication Data

US 2005/0060837 A1 Mar. 24, 2005

Related U.S. Application Data

(60) Provisional application No. 60/319,763, filed on Dec. 10, 2002.

(51) Int. Cl.
*A47L 9/32* (2006.01)

(52) U.S. Cl. ..... 15/410; 15/320; 15/353

(58) Field of Classification Search ..... 15/410, 15/353, 320; 16/436, 438, 408, 429; *A47L 9/32*
See application file for complete search history.

(56) References Cited

U.S. PATENT DOCUMENTS

| | | | | |
|---|---|---|---|---|
| 3,079,626 A | | 3/1963 | Yonkers et al. | |
| 3,203,707 A | * | 8/1965 | Anderson | 15/49.1 |
| 3,204,272 A | * | 9/1965 | Greene et al. | 15/49.1 |
| 3,758,914 A | | 9/1973 | Nupp et al. | |
| 4,155,143 A | | 5/1979 | Garbe | 15/410 |
| 4,381,766 A | | 5/1983 | Avolio | |
| 4,512,057 A | | 4/1985 | Laing et al. | 15/320 |
| 4,660,246 A | | 4/1987 | Duncan et al. | 15/329 |
| 4,662,026 A | | 5/1987 | Sumerau et al. | 15/329 |
| RE32,751 E | | 9/1988 | Joss et al. | 15/329 |
| 4,876,763 A | | 10/1989 | Cho et al. | 15/329 |
| 4,980,945 A | | 1/1991 | Bewley | 15/339 |
| 5,548,866 A | | 8/1996 | Reed et al. | 15/320 |
| 5,867,862 A | | 2/1999 | Ahlf et al. | 15/329 |
| 6,167,587 B1 | | 1/2001 | Kasper et al. | 15/320 |
| 6,768,073 B1 | * | 7/2004 | Tondra et al. | 200/332.2 |
| 2005/0091783 A1 | * | 5/2005 | Sepke et al. | 15/320 |

FOREIGN PATENT DOCUMENTS

| | | | |
|---|---|---|---|
| GB | 2403647 A | | 1/2005 |
| JP | 8-299237 | * | 11/1996 |
| JP | 2000-166836 | * | 2/2000 |

* cited by examiner

*Primary Examiner*—Theresa T. Snider
(74) *Attorney, Agent, or Firm*—McGarry Bair PC

(57) ABSTRACT

A portable surface cleaner comprises a cleaner base and an upright handle assembly pivotably connected to the cleaner base. A lower portion of the handle comprises an upper, pivot section and a lower, base section joined by a horizontal pivot axis so that the pivot section can rotate downwardly to fold against the base section to form a compact configuration for packaging, shipment, and display and pivot upwardly for assembly of the upright handle assembly prior to use.

15 Claims, 7 Drawing Sheets

SURFACE CLEANER WITH FOLDING UPRIGHT HANDLE AND METHOD OF PACKAGING SAME

CROSS REFERENCE TO RELATED APPLICATIONS

This application claims the benefit of U.S. Provisional Application Ser. No. 60/319,763, filed Dec. 10, 2002.

BACKGROUND OF INVENTION

1. Field of the Invention

The invention relates to surface cleaners for cleaning carpets and flooring. In one of its aspects, the invention relates to a cleaner having a handle assembly that has a compact form for shipping and for placement in a packaging carton and is easily assembled. In one of its aspects, the invention relates to an extraction cleaner that has a compact shape for shipping and display and is easily assembled into a full handle cleaner after removal from the shipping and display container. In another of its aspects, the invention relates to a vacuum cleaner that has a compact shape for shipping and display and is easily assembled into a full handle cleaner after removal from the shipping and display container. In yet another of its aspects, the invention relates to a method of packaging a cleaner with an upright pivotal handle in a compact configuration.

2. Description of the Related Art

Household extraction cleaners for use by a consumer to clean carpets and flooring can be purchased at a variety of retail outlets, from specialty stores to warehouse-type home improvement stores. Typically, the consumer purchases the extraction cleaner in a prepackaged, partially assembled configuration, and must complete the assembly of the extraction cleaner prior to use. This frequently includes completing the assembly of an operating handle, which has been separated into sub-assemblies for packaging. The handle is typically separated into a lower portion that remains attached to a base module and an upper portion that must be attached to the lower portion to assemble the handle. Even with the handle separated into two portions, the size of the extraction cleaner complicates packaging and necessitates a relatively large carton.

Retail outlets frequently limit the shelf space available for a particular product. The number of units that can be displayed on a limited amount of shelf space is directly proportional to the size of each unit. As the number of units that can be displayed decreases, the likelihood that the product will be sold out and, therefore, unavailable to a prospective purchaser until the shelf is restocked increases. Consequently, it is important to minimize the package volume to maximize the number of units that can be stored in any available shelf space. Reduction of package volume not only improves the number of packages on a given space, it also decreases the shipping costs because a greater number of packages can be included in a shipping container, whether by sea, air, truck or rail.

U.S. Pat. No. 6,167,587 to Kasper discloses an upright deep cleaner with a base and an upright handle pivotally mounted to the base. The upright handle, which is assembled by the consumer after purchase, comprises an upper handle section and a lower handle section pivotally mounted to the base. A clean solution tank, a recovery tank, and a suction motor are located on the base, and electrical and mechanical controls are housed in the lower handle section. The upper handle section contains a fluid distribution actuation manual link, which mates with a corresponding trigger valve in the lower handle section when the upper handle section is attached to the lower handle section. The upper handle section and lower handle section are secured with two screws through the front of the upright handle.

U.S. Pat. No. 3,079,626 to Yonkers discloses a combination stick vacuum cleaner and stick floor scrubber wherein interchangeable vacuum cleaner and floor scrubber modules are mounted to a handle with a vacuum motor. The floor scrubbing module has a base with a suction opening and a lower handle housing that includes a solution tank and a recovery tank. The upper portion of the handle houses the suction motor and the electrical supply for the motor. The floor scrubbing modules are connected to the upper handle by a releasable hinge and latch mechanism for quick assembly of the floor scrubbing module to the upper portion of the handle. No electrical devices are in the floor scrubbing module. A hinge bracket connects a fan housing on the upper power unit to a corresponding hinge bracket affixed on a lower tank unit of the floor scrubbing module tank. The user changes the lower tank by physically separating the tank module from the upper handle power unit.

U.S. Pat. No. Re. 32,751 to Joss et al. discloses a stick vacuum cleaner wherein an upper handle portion is connected to the body of the deep cleaner through a hinge for rotation of the handle rearwardly about the body of the handle to a position lying adjacent to the body of the handle to convert the cleaner from an upright vacuum to a portable hand held vacuum cleaner.

U.S. Pat. No. 6,108,862 to Frederick discloses an upright self-propelled vacuum cleaner wherein an upper end of a transmission control link and a hand grip associated with an upper handle assembly are automatically inter-connected when the upper handle assembly is attached to a lower bag housing. The assembled upper handle assembly is secured to the bag housing with two screws.

U.S. Pat. No. 4,155,143 to Garbe discloses an upright vacuum cleaner with an upper tubular handle that is separable from a lower rigid bag housing for knockdown shipment and comprises a bore on the lower rigid bag housing containing a split tubular mounting bracket that receives the hollow tubular handle and projects vertically from the bore. The upper tubular handle is secured to the lower rigid bag housing with two screws.

U.S. Pat. No. 4,980,945 to Bewley discloses a canister vacuum cleaner with a multi-sectional and disconnectable wand assembly wherein the various sections of the wand fit together by way of friction fit.

U.S. Pat. No. 5,548,866 to Reed discloses an upright deep cleaner with an upper handle portion that attaches to a lower body shell with two screws.

U.S. Pat. No. 4,512,057 to Laing discloses an upright vacuum cleaner with an upper handle assembly that is secured to a lower main housing half with two screws.

SUMMARY OF INVENTION

According to the invention, a portable surface cleaning apparatus comprises a base module for movement along a surface, a segmented handle assembly comprising an upper handle portion removably attached to a lower handle portion, said lower handle portion pivotally attached to the base module, and a debris recovery system. The debris recovery system comprises a recovery container associated with one of the base module and segmented handle assembly, a suction nozzle associated with the base module, a working air conduit extending between the recovery container and the suction nozzle, and a vacuum source in fluid communication with the recovery container for generating a flow of working air from the suction nozzle through the working air conduit and through the recovery container to thereby draw debris from a surface to be cleaned through the suction nozzle and working air conduit and into the recovery container. The lower handle portion comprises a base section, a pivot section, and a pivot mounting. The pivot section is pivotally attached to the base section by the pivot mounting for rotation of the pivot section about the pivot mounting so that the pivot section can be folded to a first position against the base section to place the extraction cleaner into a compact configuration, and unfolded to a second, upright position to form the handle assembly for maneuvering the extraction cleaner.

In one embodiment, the recovery container includes a porous filter bag to filter dirt and debris from the air.

In another embodiment, the portable surface cleaning apparatus can further comprise a centrifugal particle separator in which debris and dirt are removed from the working air and are passed through an outlet of the centrifugal particle separator. The recovery container is connected to the outlet of the centrifugal particle separator.

In another embodiment, the vacuum source is mounted to one of the base module and the lower handle base section, and an electrical distribution system includes an electrical switch mounted on one of the lower handle portion pivot section and the upper handle portion. An electrical connector is positioned between the electrical switch and the vacuum source. In one embodiment, the electrical connector has slack to accommodate the pivoting of the lower handle portion pivot section and the lower handle base section.

In an alternative embodiment, the electrical connector has a separable connector mounted to the lower handle portion pivot section and to the lower handle base section. The connector separates when lower handle portion pivot section rotates from the second position to the first position and the separable connector is joined when the lower handle portion pivot section is in the second position. The separable connector is automatically joined when the lower handle portion pivot section pivots from the first position to the second position.

The portable surface cleaning apparatus can further comprise a fluid dispensing system comprising a fluid dispenser associated with the base module for applying cleaning fluid to a surface to be cleaned, a fluid supply chamber for holding a supply of cleaning fluid, and a fluid supply conduit fluidly connected to the fluid supply chamber and to the fluid dispenser for supplying cleaning fluid to the fluid dispenser. The recovery container further comprises an air-fluid separator to remove fluids from the working air and deposit the fluids in the recovery container and an outlet opening for exhausting separated air from the recovery container.

Further according to the invention, a portable surface cleaning apparatus comprises a base module for movement along a surface, a handle assembly pivotally attached to the base module; a debris recovery system including a recovery container, a suction nozzle associated with the base module, a working air conduit extending between the recovery container and the suction nozzle; and a vacuum source in fluid communication with the recovery container for generating a flow of working air from the suction nozzle through the working air conduit and through the recovery container to thereby draw debris from a surface to be cleaned, through the suction nozzle and working air conduit and into the recovery container. Further, the handle is formed by a base section; and a pivot section which is pivotally attached to the base section for rotation of the pivot section with respect to the base section so that the pivot section can be folded to a first position against the base section to place the extraction cleaner into a compact configuration, and unfolded to a second, upright position to form the handle assembly for maneuvering the extraction cleaner.

In a preferred embodiment of the invention, the handle is attached to a rear portion of the base module; the base section and the pivot sections each have a front surface and a rear surface and the pivot section is pivotally mounted to the base section so that the pivot section pivots rearwardly from the upright position to the compact configuration with the rear surfaces of the pivot section and the base section facing each other.

In one embodiment, the portable surface cleaning apparatus comprises a fluid dispensing system that includes a fluid dispenser associated with the base module for applying cleaning fluid to a surface to be cleaned, a fluid supply chamber associated with the base module for holding a supply of cleaning fluid; and a fluid supply conduit fluidly connected to the fluid supply chamber and to the fluid dispenser for supplying cleaning fluid to the fluid dispenser.

In a further embodiment, the recovery container further comprises an air-fluid separator to remove fluids from the working air and deposit the fluids in the recovery container and an outlet opening for exhausting separated air from the recovery container. Further according to the invention, a method of packaging a portable surface cleaning apparatus that includes a handle pivotally mounted to a base that is adapted to move along a floor surface comprises the steps of forming the upright handle with separate upper and lower portions that can be separated from each other for shipment and can be easily joined together in an aligned relationship at a destination by a customer. The lower portion of the upright handle is formed with upper and lower sections that can be manipulated into a relatively compact relationship for shipping and can be easily configured into a less compact aligned relationship for customer use. The lower section of the handle lower portion is mounted to the base for pivotal movement with respect to the base, separating the upper and lower portions from each other. The upper and lower sections are manipulated into the more compact relationship and the base with the handle lower section pivotally mounted thereto is placed into a packaging container with the upper section of the lower portion of the handle in the more compact relationship. The upper portion of the handle is placed into the packaging container and the container is closed.

The step of forming the lower portion of the upright handle with upper and lower sections includes hinging the lower and upper sections of the lower portion of the handle for movement between the aligned and more compact relationships.

DETAILED DESCRIPTION

Figure 1:
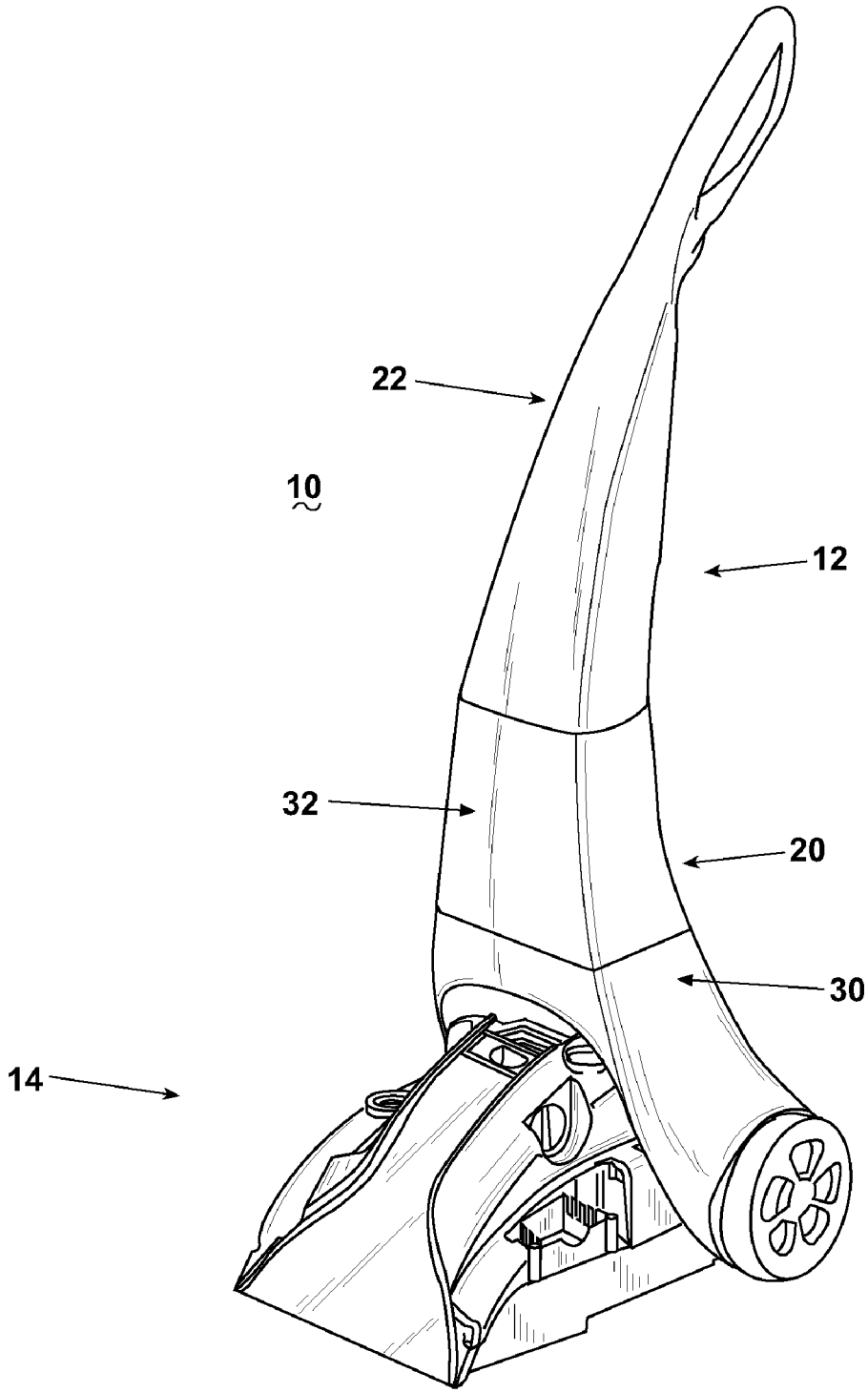
FIG. 1 is a perspective view of an assembled extraction cleaner comprising a base module with an attached lower handle portion and an upper handle portion according to the invention.

Referring to FIG. 1, an extraction cleaner 10 for cleaning surfaces of such as carpeting and floors is shown comprising an upright, segmented handle assembly 12 pivotally attached to a base module 14 in a generally conventional manner. Electrical and mechanical controls, which will be discussed in more detail hereinafter, are housed within the handle assembly 12. The extraction cleaner 10 comprises many of the elements of the extraction cleaner shown and described in U.S. Pat. No. 6,167,587 to Kasper, which is incorporated herein by reference in its entirety.

The extraction cleaner can comprise a fluid dispensing system including a fluid dispenser, a fluid supply tank with a fluid supply chamber, and a fluid supply conduit for depositing cleaning fluids to the surface to be cleaned. A trigger-type solution delivery mechanism in the handle assembly 12 is used to deliver a cleaning solution to the surface to be cleaned from a fluid supply tank mounted to the handle assembly 12 or the base module 14.

The extraction cleaner can further comprise a debris recovery system including a recovery container with a recovery chamber, a working air conduit, and a suction nozzle attached to the base module 14. A vacuum source such as a suction motor/fan in the base module 14 or the lower portion of the handle assembly 12 extracts a solution of water, detergent, and soil from the surface being cleaned through the suction nozzle and working air conduit to the recovery container. The recovery container can be a recovery tank with an air-fluid separator to remove and deposit fluids and debris from the working air as the working air passes through the recovery container. The recovery tank can also comprise an outlet opening for exhausting air after the working air passes through the air-fluid separator. Alternatively, the recovery container can be a porous filter bag as found in a conventional vacuum cleaner and as more fully described in U.S. Pat. No. 6,108,862 to Frederick, which is incorporated herein by reference in its entirety. Furthermore, the recovery container can be in communication with a cyclonic or centrifugal particle separator, which is also commonly found in vacuum cleaners and is more fully described in U.S. Pat. No. 6,260,234 to Wright et al., which is incorporated herein by reference in its entirety. In the centrifugal particle separator, debris and dirt are removed from the working air and are passed through an outlet in communication with the recovery container. The extraction cleaner 10 also includes tools (not shown) for cleaning upholstery, stairways, and other small areas.

The segmented handle assembly 12 comprises a lower handle portion 20, which is pivotally attached at a lower proximal portion thereof to the base module 14, and an upper handle portion 22. When a consumer purchases the cleaner 10, the upper handle portion 22 is separate from the lower handle portion 20 and must be attached thereto prior to use, as hereinafter described. In the preferred embodiment, the upper handle portion 22 is snap fit to the lower handle portion 20, although the upper handle portion 22 can be attached to the lower handle portion 20 through conventional pins, threaded fasteners, or other suitable fastening devices well-known in the art and as disclosed in U.S. Pat. No. 6,108,862 to Frederick. A mounting pedestal 24, as best seen in FIGS. 2 and 3, extends from the upper end of the lower handle portion 20 and mates with a receptacle (not shown) in the upper handle portion 22 to rigidly attach the upper handle portion 22 to the lower handle portion 20.

Figure 2:
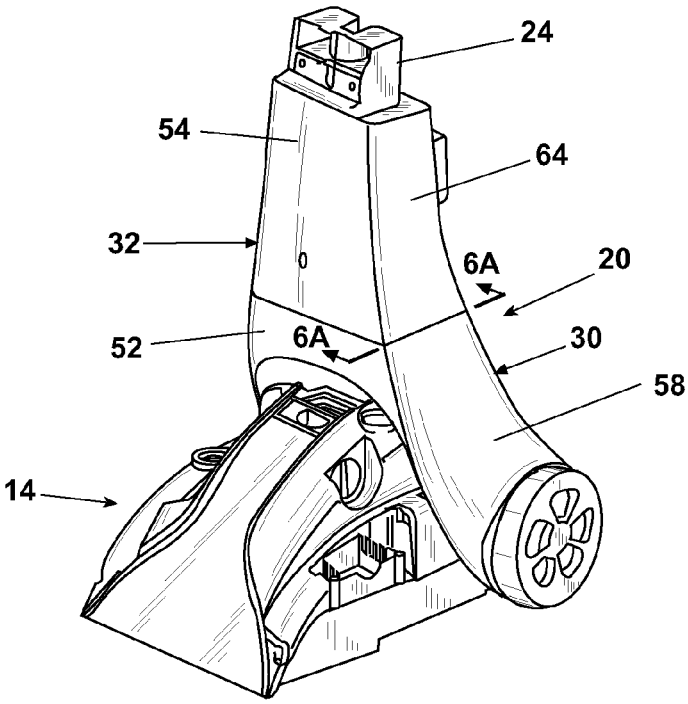
FIG. 2 is a front perspective view of the base module and the attached lower handle portion of the extraction cleaner shown in FIG. 1, wherein the lower handle portion is in an upright position.
Figure 3:
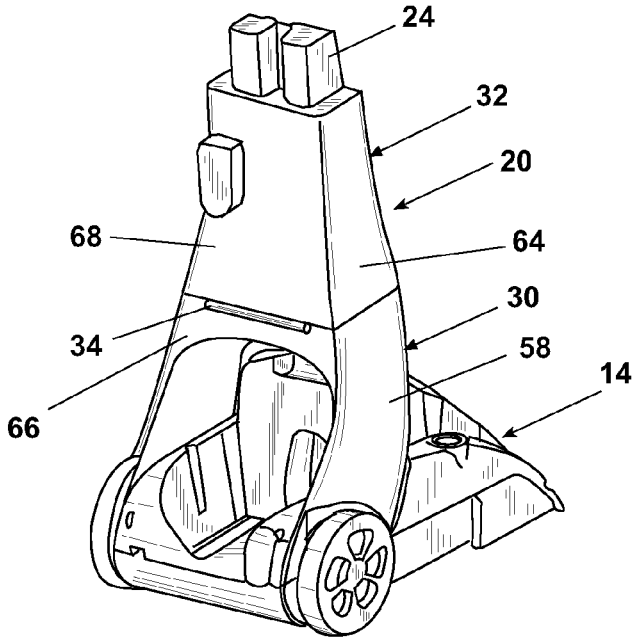
FIG. 3 is a rear perspective view of the base module and the attached lower handle portion of the extraction cleaner shown in FIG. 2.

Referring to FIGS. 2 and 3, the lower handle portion 20 is separable along a generally horizontal plane (as defined with the lower handle portion 20 in an upright position) approximately near its mid-height into a base section 30 and a pivot section 32. The base section 30 and the pivot section 32 comprise a base section forward wall 52 and a pivot section forward wall 54, respectively, which together form a forward-facing surface of the lower handle portion 20. Similarly, the base and pivot sections 30, 32 comprise a base section rear wall 66 and a pivot section rear wall 68, respectively, which form a rear-facing surface of the lower handle portion 20. The base section forward and rear walls 52, 66 are joined at their side edges by a pair of opposed side walls 58 that extend to the base module 14 to partially form the pivot attachment thereto. The pivot section forward and rear walls 54, 68 are joined along their side edges by opposed side walls 64.

Figure 4:
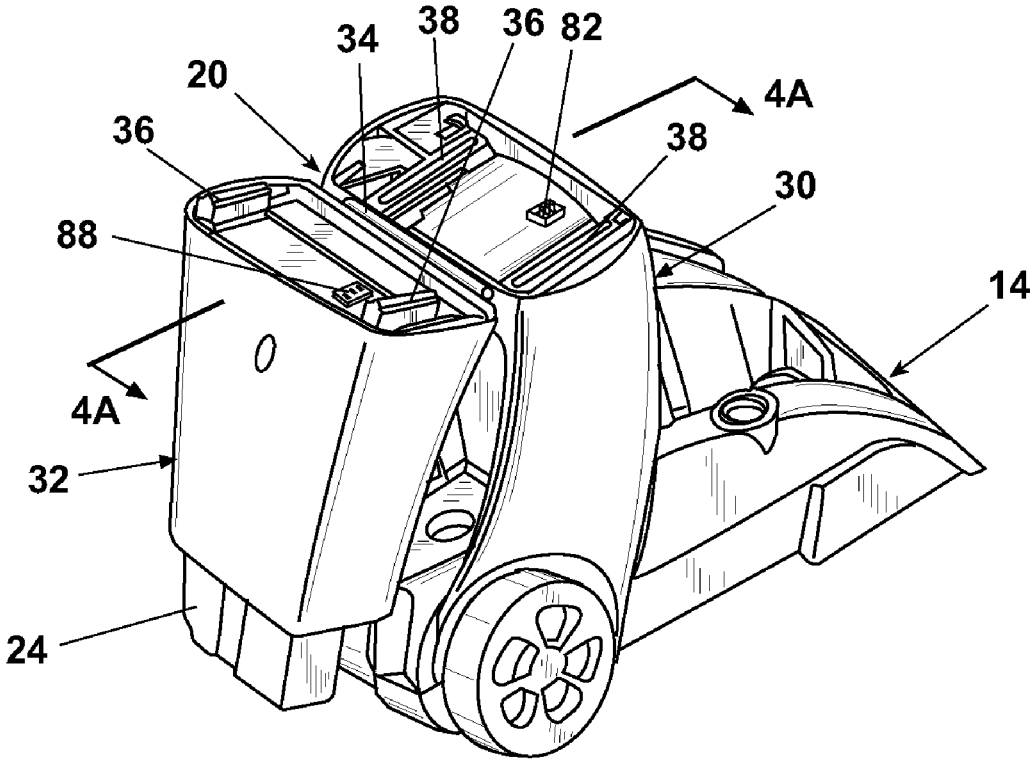
FIG. 4 is a rear perspective view of the base module and attached lower handle portion shown in FIG. 3 with the lower handle portion separated along a pivot axis into a folded position.
Figure 7:
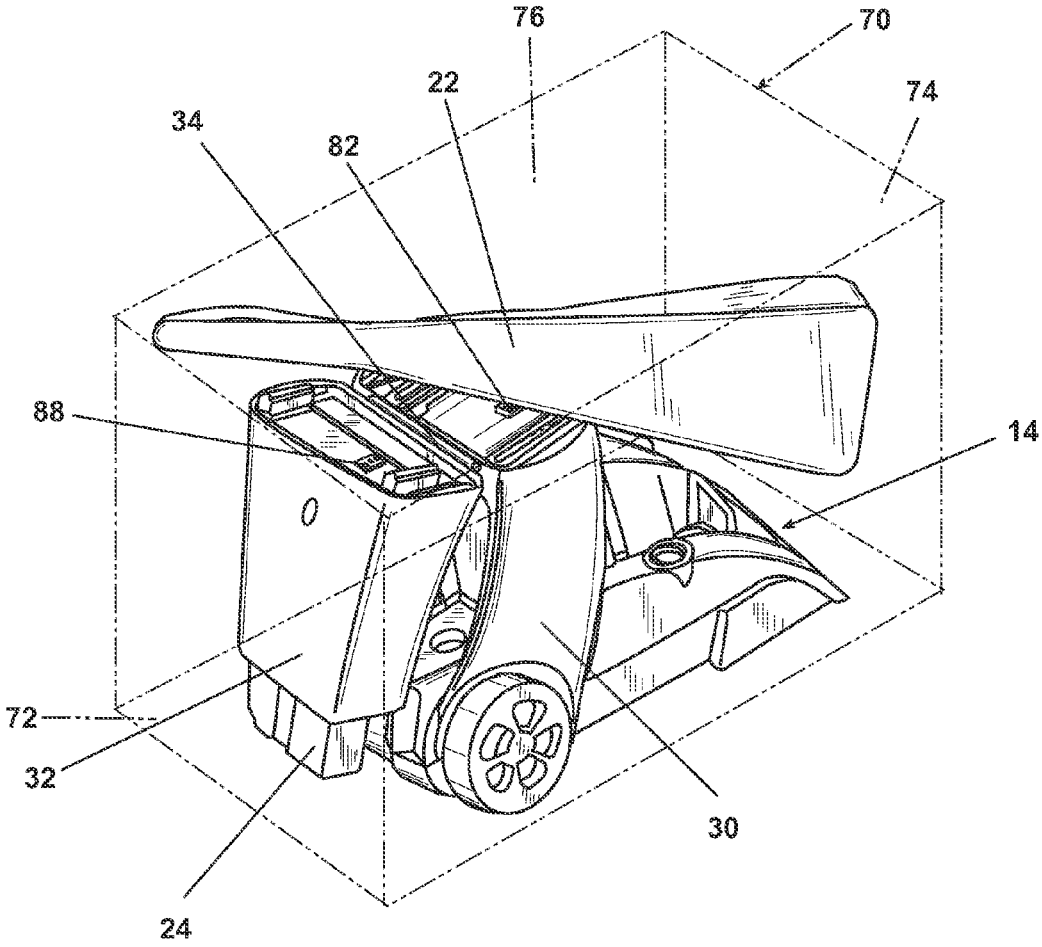
FIG. 7 is a perspective view of the extraction cleaner shown in FIG. 1 in a disassembled, folded configuration in a shipping carton.

The pivot section 32 is pivotally coupled to the base section 30 through a pivot mounting, preferably a permanent horizontal hinge 34, connecting the base section rear wall 66 to the pivot section rear wall 68 so that the pivot section 32 can rotate rearwardly to a folded position, wherein the pivot section 32 is folded against the base section 30 into a more compact configuration, as shown in FIG. 4, for placement in a packaging carton 70, as illustrated in FIG. 7. The pivot section 32 can also be rotated upwardly from the folded position against the base section 30 into an upright position to form the lower handle portion 20, as shown in FIGS. 2 and 3. When the pivot section 32 is in the upright position, the pivot section forward wall 54 aligns with the base section forward wall 52 to form a continuous forward-facing surface, and the pivot section rear wall 68 joins the base section rear wall 66 in abutting communication to form a continuous rear-facing surface. In the preferred embodiment, the lower handle portion 20 is provided with strengthening elements, such as a pair of spaced strengthening flanges 36 on the pivot section 32 and corresponding mating seats 38 formed in the base section 30. When the pivot section 32 rotates from the folded position to the upright position, the flanges 36 are received in the mating seats 38. Conjunction of these elements enhances the strength and rigidity of the lower handle portion 20 in the assembled configuration.

Figure 4A:
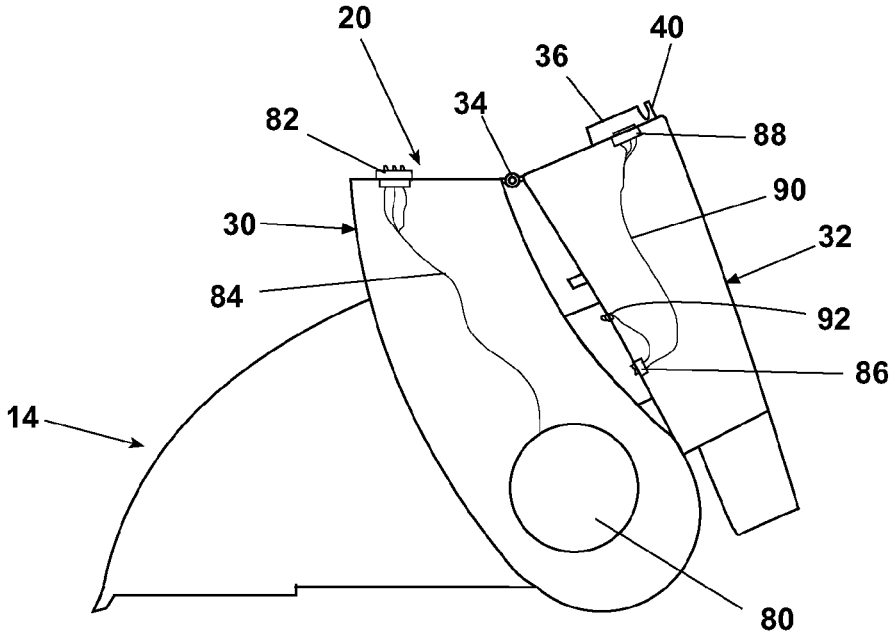
FIG. 4A is a schematic view taken along line 4A-4A of FIG. 4 and illustrates electrical components within the lower handle portion.
Figure 4B:
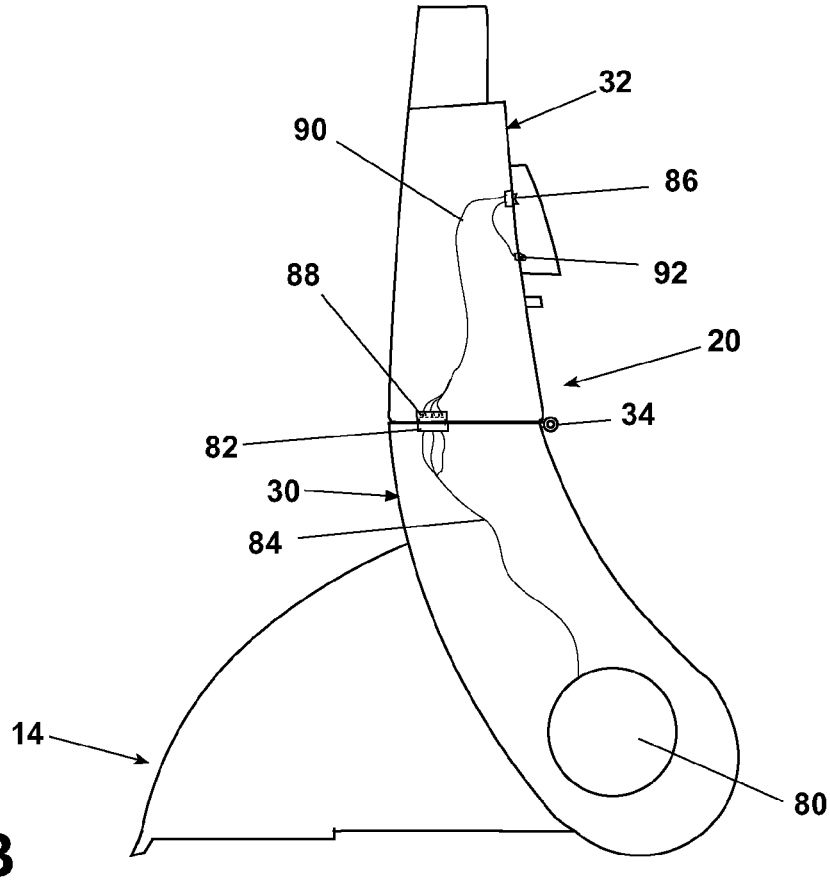
FIG. 4B is a schematic view similar to FIG. 4A with the lower handle portion in the upright position.

As schematically illustrated in FIGS. 4A and 4B, the lower handle portion 20 houses an electrical distribution system for powering a vacuum source, such as a suction motor 80, located within the base module 14. The motor 80 is electrically coupled to a male electrical connector 82 on the base section 30 through a first interconnect harness 84. An electrical switch 86 on the pivot section rear wall 86 is similarly coupled with a female electrical connector 88 on the pivot section 32 through a second interconnect harness 90. A power cord 92 delivers electricity from an electricity source, such as a household electrical outlet, to the electrical switch 86. Together, the male and female electrical connectors 82, 88 form a separable connector that is preferably automatically joined when the pivot section moves to the upright position, and the separable connector and the first and second interconnect harnesses 84, 90 provide an electrical connector between the electrical switch 86 and the vacuum source 80.

When the pivot section 32 rotates to the upright position, as illustrated in FIG. 4B, the female electrical connector 88 on the pivot section 32 receives and is, therefore, in electrical communication with the male connector 82 on the base section 30. Conjunction of the male and female electrical connectors 82, 88 establishes an electrical path from the power cord, through the electrical switch 86, and to the motor 80. As a result, activation of the electrical switch 86 when the pivot section 32 is in the upright position supplies electricity to the motor 80, which thereby creates vacuum forces for the extraction cleaner 10.

Figure 5A:
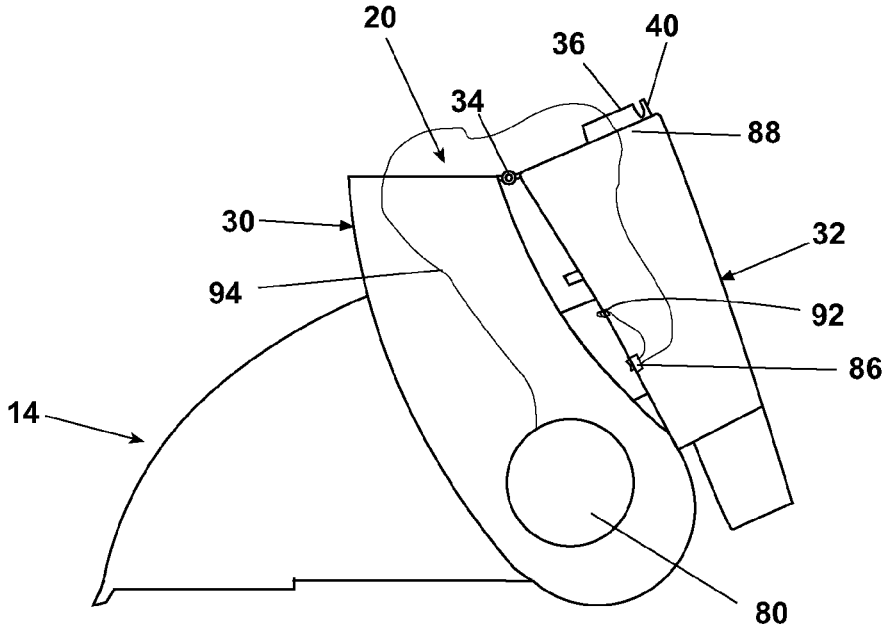
FIG. 5A is a schematic view similar to FIG. 4A and illustrates alternative electrical components.
Figure 5B:
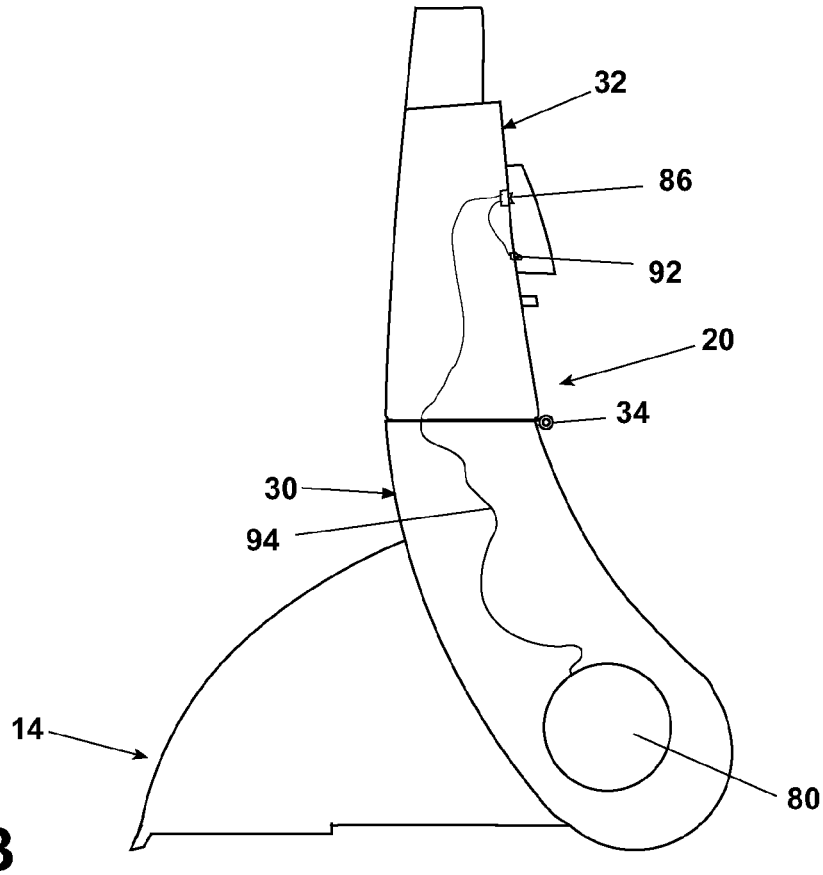
FIG. 5B is a schematic view similar to FIG. 5A with the lower handle portion in the upright position.

In another embodiment illustrated in FIGS. 5A and 5B, the electrical connector comprises a wire 94 that has sufficient slack to accommodate relative movement of the various components of the extraction cleaner 10. For example, the slack in the electrical connection 94 accommodates pivoting of the pivot section 32 between the upright position, as shown in FIG. 5A, and the folded position, as shown in FIG. 5B.

The electrical system can also be in communication with an agitator, a heater, a fluid pump, or other motor-activated components in the extraction cleaner 10. Further, it is apparent to one skilled in the art that the electrical controls can be rearranged or positioned elsewhere within the lower handle portion 20 provided that an electrical connection between the base section 30 and the pivot section 32 is established when the latter is in the upright position. For example, the electrical switch 86 can be positioned on either the base section 30, the pivot section 32, or on the upper handle portion 22.

Figure 6A:
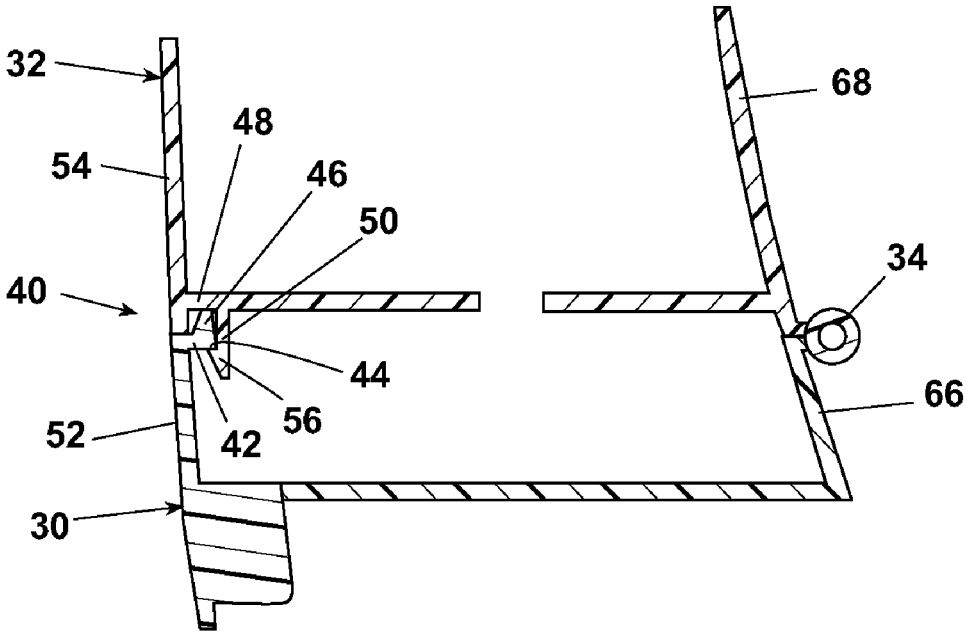
FIG. 6A is a partial cross-section of the lower handle portion taken along line 6A-6A of FIG. 2 and showing a Pivot mounting and a snap lock assembly for assembling the lower handle portion into the upright position.
Figure 6B:
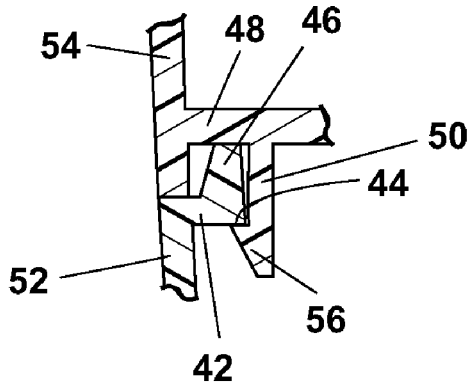
FIG. 6B is an enlarged view of the snap lock assembly shown in FIG. 6A.

Referring now to FIGS. 6A and 6B, the pivot section 32 is held in the upright position through a mechanical linkage, which is shown in the figures as a snap lock assembly 40, that is engaged when the vertical walls 52, 54 are brought into abutting communication. A base flange 42 extends generally orthogonally and inwardly from a top edge of the base section forward wall 52 to form a shoulder 44 and terminates in an upwardly extending boss 46. A snap lock flange 48 extends generally orthogonally and inwardly from the pivot section forward wall 54 and includes a downwardly depending snap finger 50 having a forward hook 56. When the pivot section forward wall 54 abuts the base section forward wall 52, the boss 46 contacts the snap lock flange 48, and the hook 56 communicates with the shoulder 44 to lock the pivot section 32 in the upright position relative to the base section 30. One or more conventional fasteners, such as pins or screws, can be used in a manner well known in the art to further secure the connection of the pivot section 32 in the upright position.

Referring now to FIG. 7, a carton 70 is shown with the disassembled extraction cleaner 10 contained therein in an exemplary configuration. The carton 70 comprises a floor 72, peripheral walls 74, and a ceiling 76. The size of the floor 72 is sufficient to support the base module 14 and the lower handle portion 20 with the pivot section 32 folded down against the base section 30 while leaving minimum clearance between the base module 14 and the peripheral walls 74. The upper handle portion 22 and any other components of the extraction cleaner 10, such as the recovery container and cleaning tools, can be packaged in the carton 70 in a compact configuration to thereby minimize the carton volume. It will be apparent to one of ordinary skill in the art that the upper handle portion 22 and other components of the extraction cleaner 10 can be placed in the carton 70 in other orientations other than that shown in FIG. 7 in order to minimize the carton volume.

To maximize the number of cleaner units that can be displayed on a given amount of shelf space, the extraction cleaner 10 according to the invention comprises the segmented handle assembly 12 with a removable upper handle portion 22 and a foldable lower handle portion 20 having a pivot section 32 hingedly attached to a base section 30. The upper handle portion 22 is removable and packaged separately from the handle assembly 12. The pivot section 32 is folded about the hinge 34 against the base section 30 to provide a compact configuration having a low profile for purposes of packaging. The base module 14 and the lower handle portion 20 with the pivot section 32 folded against the base section 30 is placed in a packaging carton 70 that is sized to minimize the clearance between the base module 14 and the carton walls 74. The upper handle portion 22 and any other separate components of the extraction cleaner 10 are situated in the carton 70 relative the base module 14 to minimize the space separating the upper handle portion 22 and the other components from the base module 14 so as to minimize the height of the peripheral walls 74.

To prepare the extraction cleaner 10 for use, the various components thereof are removed from the carton 70 for assembly. The base module 14 and the lower handle portion 20 is prepared by rotating the pivot section 32 about the hinge 34 from the folded position to the upright position. During rotation, the strengthening flanges 36 are inserted into the seats 38, the hook 56 engages the shoulder 44 to engage the snap lock assembly 40, and, if provided, reinforcing fasteners (not shown) are installed to form the lower handle portion 20. At the same time, the electrical controls and any operating linkages are connected. In particular, the female connector 88 receives the male connector 82 to establish the electrical path from the electrical switch 82 to the motor 80. After completing the assembly of the pivot section 32 to the base section 30, the upper handle portion 22 is attached to the lower handle portion 20 by means of the mounting pedestal 24 to form the handle assembly 12 with any electrical control wiring and mechanical linkages between the upper and lower handle portions 22, 20 operably connected.

The extraction cleaner 10 described herein can be arranged into a configuration for packaging and retail display that is more compact than a conventional segmented handle comprising an upper separable portion and a lower pivoting portion. Because of the compact configuration described herein, the extraction cleaner 10 fits into a small packaging carton to thereby increase the number of packaged units that can be displayed on a given amount of retail shelf space. Increasing the number of packaged units consequently decreases the likelihood that the product will be sold out before the shelf space can be restocked and, therefore, increases the likelihood of a sale.

The invention has particular applicability to a floor cleaning machine in which all of the operating components are in the base. The handle can remain pivotally mounted to the base but can fold through a pivotal relationship to a compact configuration for storage and for shipping. This function can be carried out in a vacuum cleaner as well as in an extraction cleaner, with or without separation of the upper handle portion separable from the lower handle portion.

While the invention has been specifically described in connection with certain specific embodiments thereof, it is to be understood that this is by way of illustration and not of limitation. It is apparent to one of ordinary skill in the art that the invention can also be applied to upright vacuum cleaners or any other upright cleaning apparatus comprising an upright pivoting handle. Reasonable variation and modification are possible within the scope of the forgoing description and drawings without departing from the spirit of the invention which is described in the appended claims.

The invention claimed is:

1. A portable surface cleaning apparatus comprising:

a base module for movement along a surface;

a segmented handle assembly comprising an upper handle portion removably attached to a lower handle portion, said lower handle portion pivotally attached to the base module;

a debris recovery system comprising;

a recovery container associated with one of the base module and segmented handle assembly;

a suction nozzle associated with the base module;

a working air conduit extending between the recovery container and the suction nozzle; and a vacuum source in fluid communication with the recovery container for generating a flow of working air from the suction nozzle through the working air conduit and through the recovery container to thereby draw debris from the surface to be cleaned through the suction nozzle and working air conduit and into the recovery container;

the improvement comprising;

said lower handle portion comprises a base section, a pivot section, and a pivot mounting, the pivot section being pivotally attached to the base section by the pivot mounting for rotation of the pivot section about the pivot mounting so that the pivot section can be pivoted to a first position toward the base section to place the portable surface cleaning apparatus into a compact configuration, and unfolded to a second, upright position to form the handle assembly for maneuvering the portable surface cleaning apparatus.

2. The portable surface cleaning apparatus according to claim 1 wherein the recovery container includes a porous filter bag to filter dirt and debris from the air.

3. The portable surface cleaning apparatus according to claim 1 and further comprising a centrifugal particle separator in which debris and dirt are removed from the working air and are passed through an outlet of the centrifugal particle separator, and wherein the recovery container is connected to the outlet to the centrifugal particle separator.

4. The portable surface cleaning apparatus according to claim 1 wherein the vacuum source is mounted to one of the base module and the lower handle base section and further comprising an electrical distribution system comprising an electrical switch mounted on one of the lower handle portion pivot section and the upper handle portion, and an electrical connector between the electrical switch and the vacuum source.

5. The portable surface cleaning apparatus according to claim 4 wherein the electrical connector has slack to accommodate the pivoting of the lower handle portion pivot section and the lower handle base section.

6. The portable surface cleaning apparatus according to claim 4 wherein the electrical connector has a separable connector mounted to the lower handle portion pivot section and the lower handle base section and the connector separates when lower handle portion pivot section rotates from the second position to the first position and the separable connector is joined when the lower handle portion pivot section is in the second position.

7. The portable surface cleaning apparatus according to claim 6 wherein the separable connector is automatically joined when the lower handle portion pivot section pivots from the first position to the second position.

8. The portable surface cleaning apparatus according to claim 1 and further comprising:

a fluid dispensing system comprising;

a fluid dispenser associated with the base module for applying cleaning fluid to the surface to be cleaned;

a fluid supply chamber for holding a supply of cleaning fluid; and a fluid supply conduit fluidly connected to the fluid supply chamber and to the fluid dispenser for supplying cleaning fluid to the fluid dispenser.

9. The portable surface cleaning apparatus according to claim 8 wherein the recovery container further comprises an air-fluid separator to remove fluids from the working air and deposit the fluids in the recovery container and an outlet opening for exhausting separated air from the recovery container.

10. The portable surface cleaning apparatus according to claim 1 wherein the pivot mounting is a hinge.

11. The portable surface cleaning apparatus according to claim 1 wherein the upper and lower handle portions of the handle assembly are fit to one another.

12. The portable surface cleaning apparatus according to claim 1 and further comprising a mechanical linkage between the base section and the pivot section for maintaining the lower handle portion in the second, upright position.

13. A method of packaging a portable surface cleaning apparatus that includes a handle pivotally mounted to a base that is adapted to move along a floor surface comprises the steps of:

forming the handle with separate upper and lower portions that can be separated from each other for shipment and can be easily joined together in an aligned relationship at a destination by a customer;

forming the lower portion of the handle with upper and lower sections that are pivotally mounted to each other so that they can be manipulated into a relatively compact relationship for shipping and can be easily configured into a less compact aligned relationship for customer use;

mounting the lower section of the handle lower portion to the base for pivotal movement with respect to the base;

manipulating the upper and lower sections of the handle lower portion into the more compact relationship;

placing the base with the lower section of the handle lower portion pivotally mounted thereto into a packaging container;

placing the upper section of the lower portion of the handle into the packaging container in the more compact relationship;

placing the upper portion of the handle into the packaging container; and closing the container.

14. The method of packaging a portable surface cleaning apparatus according to claim 13 and wherein the step of forming the lower portion of the handle with upper and lower sections includes hinging the lower and upper sections of the lower portion of the handle for movement between the aligned and more compact relationships.

15. A portable surface cleaning apparatus and shipping package assembly comprising:

a portable surface cleaning apparatus comprising;

a base adapted to move aling a floor surface; and a handle pivotally mounted to the base and comprising upper and lower portions that can be separated from each other for shipping and joined together in an aligned relationship at a destination by a customer, the lower portion further comprising upper and lower sections that are pivotally mounted to each other so that they can be manipulated into a relatively compact relationship for shipping and can be configured into a less compact aligned relationship for customer use; and a shipping container having positioned therein the portable surface cleaning apparatus with the upper and lower sections of the lower portion in the relatively compact relationship and with the upper portion separate therefrom.

* * * * *

UNITED STATES PATENT AND TRADEMARK OFFICE

CERTIFICATE OF CORRECTION

PATENT NO. : 7,219,390 B2
APPLICATION NO. : 10/707392
DATED : May 22, 2007
INVENTOR(S) : Michael A. Johnson and Kevin S. Breuker It is certified that error appears in the above-identified patent and that said Letters Patent is hereby corrected as shown below:

Column 10, claim 11, line 36, reads: "...handle assembly are fit to one another."

It should read: "...handle assembly are snap fit to one another."

Signed and Sealed this

Thirty-first Day of July, 2007

JON W. DUDAS
*Director of the United States Patent and Trademark Office*